US008662199B2

(12) United States Patent
Nyström

(10) Patent No.: US 8,662,199 B2
(45) Date of Patent: Mar. 4, 2014

(54) FEED UNIT FOR A DRILLING MACHINE

(75) Inventor: Sven-Olov Nyström, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 421 days.

(21) Appl. No.: 12/736,649

(22) PCT Filed: May 11, 2009

(86) PCT No.: PCT/SE2009/000241
§ 371 (c)(1),
(2), (4) Date: Oct. 26, 2010

(87) PCT Pub. No.: WO2009/136842
PCT Pub. Date: Nov. 12, 2009

(65) Prior Publication Data

US 2011/0048808 A1 Mar. 3, 2011

(30) Foreign Application Priority Data

May 9, 2008 (SE) ..... 0801048

(51) Int. Cl.
*E21B 19/08* (2006.01)

(52) U.S. Cl.
USPC ..... 173/189; 173/185; 173/184

(58) Field of Classification Search
USPC ..... 173/185, 184, 189
See application file for complete search history.

(56) References Cited

U.S. PATENT DOCUMENTS

| | | | | |
|---|---|---|---|---|
| 2,726,065 A | | 12/1955 | Feucht | |
| 3,612,190 A | * | 10/1971 | Wills | 173/20 |
| 3,692,124 A | * | 9/1972 | Kimber et al. | 173/160 |
| 3,729,056 A | | 4/1973 | Paurat | |
| 3,797,587 A | | 3/1974 | Klein | |
| 3,980,144 A | * | 9/1976 | Roos et al. | 173/160 |
| 3,999,805 A | | 12/1976 | Lockwood | |
| 4,069,877 A | | 1/1978 | Durand | |
| 4,124,081 A | * | 11/1978 | Deike | 173/28 |
| 4,251,046 A | | 2/1981 | Walmsley et al. | |
| 4,266,171 A | * | 5/1981 | Mashimo | 318/571 |
| 4,290,491 A | * | 9/1981 | Mayer | 173/194 |
| 4,456,077 A | | 6/1984 | Lagerstedt et al. | |
| 5,678,642 A | * | 10/1997 | Briggs et al. | 175/19 |

(Continued)

FOREIGN PATENT DOCUMENTS

| | | |
|---|---|---|
| EP | 0 140 873 | 5/1985 |
| GB | 1482093 | 8/1977 |

(Continued)

*Primary Examiner* — Brian D Nash

(74) *Attorney, Agent, or Firm* — Mark P. Stone

(57) ABSTRACT

A feed unit (105) to be used with a mining or construction machine (100), the feed unit (105) having a feeder holder (106) and a feed beam (111) able to move relative to the feeder holder (106), the feed unit (105) also having a supporting unit for a drilling machine (121), the supporting unit being arranged to support the drilling machine (121) moveably in relation to the feed beam (111), and the feed unit (105) having a driving device to move the feed beam (111) relative to the feeder holder (106) in operation. The supporting unit is attached to the feeder holder (106) such that, when the feed beam (111) moves relative to the feeder holder (106) by the driving device, the supporting unit is automatically moved at the same time along the feed beam (111). A rock drilling assembly and a rock drilling rig include the feed unit.

20 Claims, 4 Drawing Sheets

(56) References Cited

U.S. PATENT DOCUMENTS

| | | | | |
|---|---|---|---|---|
| 5,884,712 | A * | 3/1999 | Hakkinen | 173/11 |
| 5,913,573 | A | 6/1999 | Schegl et al. | |
| 6,105,684 | A | 8/2000 | Pointer et al. | |
| 6,550,544 | B1 | 4/2003 | Saf | |
| 6,672,410 | B2 | 1/2004 | Smith | |
| 6,814,155 | B1 | 11/2004 | Nielson et al. | |
| 7,032,686 | B2 | 4/2006 | Barthomeuf et al. | |
| 2005/0103509 | A1 | 5/2005 | Barthomeuf et al. | |
| 2005/0129466 | A1 | 6/2005 | Walker et al. | |
| 2006/0042811 | A1* | 3/2006 | Hagemeyer | 173/1 |
| 2007/0227752 | A1* | 10/2007 | Voimanen et al. | 173/11 |
| 2008/0169113 | A1* | 7/2008 | Rubie | 173/141 |
| 2010/0155092 | A1* | 6/2010 | Folin et al. | 173/39 |

FOREIGN PATENT DOCUMENTS

| | | |
|---|---|---|
| GB | 1498585 | 1/1978 |
| GB | 2015393 | 9/1979 |
| JP | 2005240517 | 8/2005 |
| RU | 2300616 | 6/2007 |
| SU | 607032 | 5/1978 |
| SU | 1097788 | 6/1984 |
| SU | 1567765 | 5/1990 |
| WO | WO 02/103162 | 12/2002 |

* cited by examiner

FEED UNIT FOR A DRILLING MACHINE

FIELD OF THE INVENTION

The present invention pertains to a feed unit to be used in drilling and/or bolting. In particular, the present invention pertains to a feed unit as disclosed herein. The invention also pertains to a rock drilling and/or rock bolting assembly and a rock drilling and/or rock bolting rig as also disclosed herein.

BACKGROUND OF THE INVENTION

In rock drilling and rock bolting, one often uses a rock drilling rig where one or more drilling machines are carried by respective movable arms, or booms. The booms are usually flexibly attached to a carrier, such as a vehicle, via one or more joints. Furthermore, the drilling machine is usually flexibly attached to the end of the boom away from the carrier via one or more additional joints.

However, the drilling machine is usually not attached directly to the boom, instead being normally attached to the boom in movable manner by a feed unit consisting of a feeder holder, which carries a feed beam arranged movably relative to the feeder holder, and furthermore the drilling machine is usually displaceable relative to the feed beam to achieve great freedom of adjustment during drilling thanks to the telescopic action, without the carrier having to move around.

Depending on the type of drilling, such as tunneling or ore mining, different types of rock drilling rigs are used. For example, when driving a tunnel, one often uses large machines with a plurality of booms, so as to drill a plurality of holes at the same time, or nearly so, and to reach across a large portion or the entire, usually relatively broad cross sectional surface that the tunnel requires from a single supporting position.

In ore mining, on the other hand, it is often desirable for economic reasons to mine the ore in such a way that only the ore body is mined, thereby reducing as much as possible the amount of excess rock that needs to be handled. This means that, when mining small ore bodies and/or when only a small portion of the ore body contains the desired ore, the mining can occur at very low gallery heights, with corresponding requirements for the rock drilling rig.

Thus, different situations make different demands on the feed unit, and therefore feed units occur in many different designs. Regarding the feed beam, this often consists of a steel beam or U-shaped aluminium beam, where the drilling machine is mounted on a carriage which then runs along the feed beam, for example, carried by round rods (guideways), or mounted by slide bearings. The movement of the drilling machine (carriage) along the feed beam is usually driven for example by a hydraulic motor or hydraulic cylinder, which drives the carriage directly or via for example a wire or chain. Correspondingly, a hydraulic cylinder is also often used to move the feed beam along the feeder holder.

The feed beam can also be designed with telescopic function, e.g., by having two beams running telescoping one in the other, where one of which (the displaceable) being provided with the carriage bearing the drilling machine.

For feed units in general, and particularly feed units designed for drilling in galleries with low height, it is desirable to not only provide the desired function, but also fulfil the current design constraints at the same time, e.g., as regards the size of the rock drilling rig. But it can be difficult to create a feed unit that simultaneously fulfils both functional requirements and design requirements in a desired manner, especially for rock drilling rigs designed for very narrow galleries. Therefore, there is a need for an improved feed unit.

SUMMARY OF THE INVENTION

One purpose of the present invention is to provide a feed unit which solves the above problem. This purpose is accomplished with a feed unit in accordance with the present invention.

The present invention pertains to a feed unit to be used with a mining and/or construction machine, said feed unit comprising a feeder holder and a feed beam displaceable relative to the feeder holder, said feed unit further comprising a supporting unit to carry a drilling machine, wherein said supporting unit is arranged to carry said drilling machine displaceable in relation to said feed beam, and said feed unit furthermore comprises driving means to move said feed beam relative to said feeder holder in operation. Said supporting unit and/or drilling machine is attached to said feeder holder in operation such that, when said feed beam moves relative to said feeder holder thanks to said driving means, the supporting unit and/or drilling machine is automatically moved at the same time along the feed beam.

The present invention has the advantage that, thanks to using a single actively controlled drive mechanism, which by driving the feed beam relative to the feeder holder at the same time achieve the supporting unit and/or drilling machine to move automatically along the feed beam, it reduces the number of space-consuming drive mechanisms, such as hydraulic motors or hydraulic cylinders, and it reduces the need for couplings to transmit the driving agent, such as hydraulic fluid, between mutually moving parts, since, e.g., a hydraulic cylinder integrated with the feeder holder or attached to the feeder holder can be used to drive the feed beam relative to the feeder holder by active control of the cylinder piston, and the drilling machine is suitably arranged to move automatically along the feed beam in response to the movement of the feed beam relative to the feeder holder.

Such an arrangement is especially suitable for feed units designed for rock drilling rigs, which in turn are designed to work at low gallery height. The reduction in the number of required drive motors affords a more compact design, which can be made robust at the same time.

The invention also pertains to a rock drilling assembly and a rock drilling and/or rock bolting rig.

DETAILED DESCRIPTION OF SAMPLE EMBODIMENTS

Figure 1:
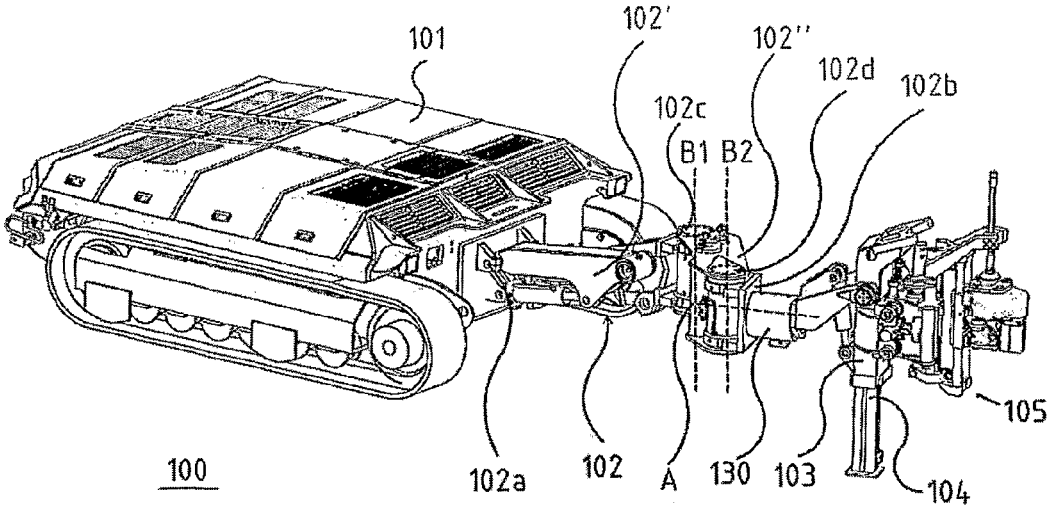
FIG. 1 shows a rock drilling rig designed to be used in drilling and/or rock bolting at very low gallery height.

FIG. 1 shows a mining machine in the form of a rock drilling rig 100, which is especially suitable to be used in drilling and/or bolting when working in very low galleries. For example, there are galleries with a height on the order of 1.2 m, where bolting has to be done with bolt lengths of 1.6 m, for example, to reduce the risk of for example a cave in.

The rock drilling rig 100 shown consists of a carrier 101 and a boom 102, whose one end 102*a* is fastened to the carrier. The boom 102 consists of two sections 102', 102", joined by a rotational joint 102*c* to afford great freedom of adjustment during drilling, while at the same time the outer boom section 102" can be retracted around the axis of rotation B1 to facilitate transport (e.g., by reducing the risk of hitting the surrounding rock). The boom 102 further comprises, besides having an outer section able to rotate relative to the inner part, a rotational joint 102*d* to allow making the rock drilling rig 100 relatively compact during transport, with boom retracted and feed unit rotated into a suitable position about the axis of rotation B2, thanks to the rotational joint 102*d* (as described below). This has the benefit of greatly facilitating transport in narrow galleries.

At the end 102*b* of the boom 102 away from the carrier 101, a drilling support 103 with support leg 104 is arranged. To the drilling support 103 is fastened a feed unit 105 according to the present invention.

The feed unit/drilling support is attached to the boom via a rotational linking means 130 to allow drilling not only in an upward direction, as shown, but in any radial direction looking from the axis A of the rotational linking means 130.

A carrier 101 of the type in FIG. 1 is usually controlled not by an operator on board the carrier (due to the relatively small size of the carrier), but instead the rock drilling rig 100 can be controlled remotely by an operator at a suitable control unit, which can be connected to the drilling rig by a cable, for example, or a wireless interface.

The carrier 101 is provided as usual with functions required by the rock drilling rig, such as control units and hydraulic pumps to drive for example the boom/drilling support/feed unit/drilling machine. The carrier can also have means to operate said hydraulic pump(s), such as an internal combustion engine and/or electric motor, which for example can be operated by connection to appropriate electrical mains.

Figure 2:
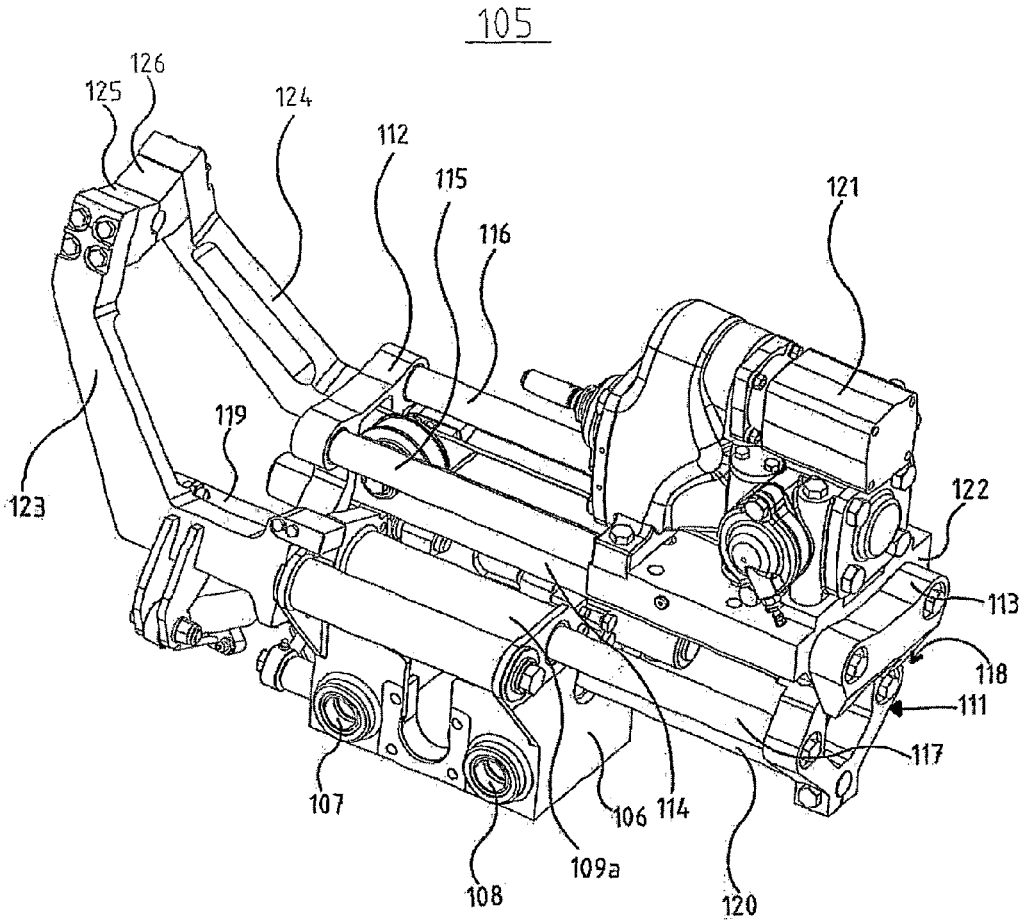
FIG. 2 shows the feed unit of FIG. 1 in more detail.

FIG. 2 shows the feed unit of the invention in detail. The feed unit 105 consists of a feeder holder 106, which in operation is fastened to the drilling support 103 in appropriate manner. The feeder holder can, for example, be fastened to the drilling support by suitable fastening connection, such as bolts, but in the embodiment shown the feeder holder is attached to the drilling support via openings (lead-through bushings) 107, 108, which can be displaced by a hydraulic cylinder 503 (see FIG. 5) along guideways 501, 502, shown below with their function described in connection with FIG. 5.

The feeder holder 106 further comprises lead-through bushings 109*a* (and the corresponding 109*b*, concealed by the feed beam). Moreover, a feed beam generally designated 111 and consisting of end pieces 112, 113, joined by a web of spar 114 and two guideway pairs 115, 116 and 117, 118, is attached to the feeder holder.

The feed beam 111 is movably attached to the feeder holder 106 in that the guideway pair 117, 118 runs in the lead-through bushings 109*a*, 109*b*. The feed beam 111 is driven relative to the feeder holder 106 by a hydraulic cylinder (feed cylinder) 119, whose piston 120 is attached to the end piece 113. The operation of the feed cylinder 119 produces a "stroke length" for the feed beam basically corresponding to the length of the available part of the guideway 117 in the figure.

Moreover, a drilling machine 121 is movably attached to the feed beam 111 by a support unit running on guideways 115, 116 in the form of a carriage 122. This allows a telescopic feeding of a drill string or rock bolt connected to the drilling machine 121, the total feeding length consisting of the above-mentioned feed beam feeding length and basically the available length of guideways 115, 116 in front of the carriage (it should be understood that for design factors, the movement of the feed beam 111 relative to the feeder holder 106 or the movement of the carriage 122 relative to the feed beam 111 will be limited so that the entire theoretical stroke length cannot be utilised).

Besides said telescopic feeding, FIG. 2 also shows a further drilling support consisting of two arms 123, 124, which are not part of the present invention, but which can come together during operation so that the holder device 125, 126 encloses the drill string or rock bolt during drilling/bolting to facilitate control of same.

The feed unit shown in FIG. 2 is thus very compact, and hence especially suitable to be used in drilling/bolting in extremely narrow (low) galleries. However, the present invention consists of the drive mechanism by which the drilling machine 121 (carriage 122) moves along the feed beam 111. In customary feed units, separate and independent actively controlled drive mechanisms (such as feed cylinder 119) are used to drive the movement of the feed beam 111 relative to the feeder holder 106, or to drive the carriage (drilling machine) along the feed beam. The carriage, e.g., can be designed to be driven by a hydraulic cylinder; alternatively, the carriage (drilling machine) can be driven forward/backward by use of a so-called chain feeder, where a chain is driven by a hydraulic gear motor.

The present invention provides a layout where only one actively controlled drive device is used (the feed cylinder 119), yet movement of the carriage 122 relative to the feed beam still occurs at the same time as and depending on the feed cylinder's movement of the feed beam relative to, the feeder holder 106 in that the carriage is attached to the feeder holder via fastening devices such as a chain or a wire.

Figure 3:
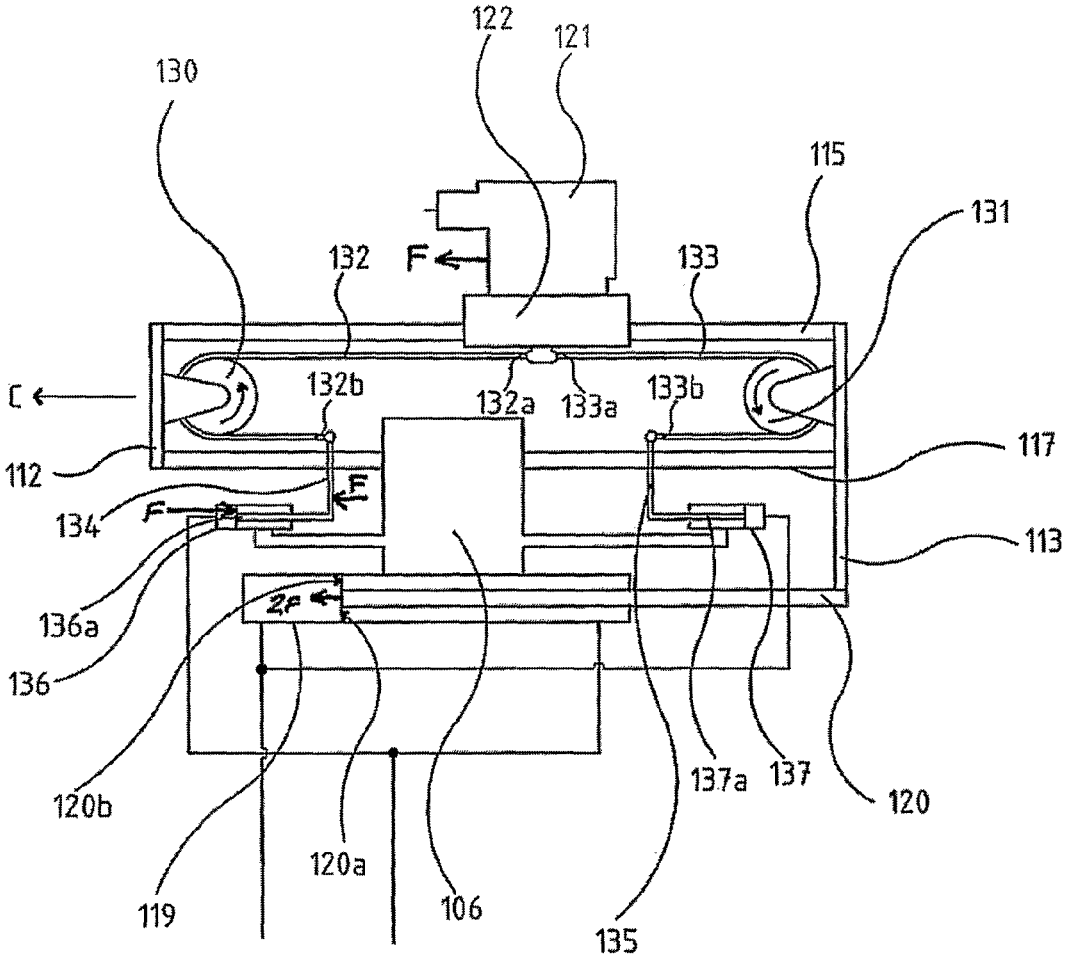
FIG. 3 shows a schematic cross section of the feed unit in FIG. 2.

To better explain the invention, FIG. 3 shows a schematic cross section of the feed unit of FIG. 2. It shows schematically the feeder holder 106, the feed cylinder 119 with piston 120, the end sections 112, 113 and guideways 115 (116), 117 (118). Moreover, the figure shows pulley wheels 130, 131 at respective ends of the feed beam, whose function is described below.

The driving of the carriage 122 (drilling machine 121) relative to the feed beam is designed so that the carriage is connected to respective ends 132*a*, 133*a* of chains 132, 133, which in turn run around the respective pulley wheels 130, 131 to be then fastened by respective opposite ends 132*b*, 133*b* to the feeder holder 106, in this case, by a respective chain tensioner.

Each respective chain tensioner consists of a device 134 or 135, and a tensioning piston 136*a* or 137*a*, as shall be described more closely below. The tensioning pistons 136*a*, 137*a* travel in respective hydraulic cylinders 136, 137 firmly connected to the feeder holder 106, and thus the chains 132, 133 are fastened to the feeder holder 106 via said devices 134, 135, tensioning pistons 136*a*, 137*a*, and hydraulic cylinders 136, 137 (whose function is described further below).

The solution per FIG. 3 has the benefit that, when the feed cylinder piston 120 is pushed into the feed cylinder 119 (by applying pressure to pressure surface 120*a*), the feed beam will move in direction C, and the pulley wheel 130 will move further and further away from the feeder holder 106, so that the chain 132 is pulled around the pulley wheel 130 in the direction shown by the figure, so that in turn the carriage will come closer to the end section 112.

In similar fashion, the pulley wheel 131 is moved in the direction towards the feeder holder 106, so that the chain 133 follows the chain 132. This produces a forward feeding of the feed beam 111 relative to the feeder holder 106, and at the same time a forward feeding of the carriage 122 (drilling machine 121) relative to the feed beam 111. By suitably adapting the feed cylinder's 119 length or the distance between the pulley wheels 130, 131, one can achieve a layout where the fully retracted feed cylinder piston results in that the drilling machine is in its left-hand end position in the figure and, vice versa, a fully extended feed cylinder piston means that the drilling machine is in its retracted (right-hand in the figure) end position.

Thus, the present invention provides a very space-saving solution for the feed unit's drive mechanism, where only one actively driven driving means (feed cylinder 119) is needed to produce both movement of feed beam relative to feeder holder and carriage relative to feed beam. Moreover, one can also ensure that the drilling machine is always at its respective end position when the feed cylinder's piston is at its respective end position.

The embodiment shown has a further advantage. As noted above, the respective chain ends 132*b*, 133*b* are connected to the feeder holder via respective chain tensioners. These hydraulic cylinders replace the customary chain tensioners normally needed to compensate for the change in chain length that eventually occurs in such layouts, e.g., due to wear on the chain links and/or pulley wheels. Normally, one uses chain tensioners with tension screws, and the chains are manually stretched with equal spacings by appropriate adjustment of the tension screws. Thus, besides having to do the adjustments manually, these tension screws take up a lot of room and thus have negative impact on a layout such as that of FIG. 2-3, where a very compact feed unit is desirable to be used in the expected very low gallery heights.

The use of a chain tensioner according to the present invention, i.e., the use of the hydraulic cylinders 136, 137, has the benefit of achieving a fully automatic chain tensioning. Since either the forward 136 or rear 137 hydraulic cylinder (or both) is pressurised depending on the direction of movement of the carriage, a correct chain tension can be assured at all times, thus also ensuring that there is never slack in the chain, regardless of how worn down it is.

Moreover, the use of the two hydraulic cylinders 136, 137 has the benefit that, by pressurising the tensioning piston 136*a* as above, during or after forward feeding with the feed cylinder it is possible to extend the cylinder's 136 tensioning piston 136*a*, which in turn pulls a larger portion of the chain 132 around the pulley wheel 130, thus producing a further travel length for the carriage in the drilling direction. In similar fashion, the tensioning piston 137*a* can be pushed into the cylinder 137 during forward feeding, so that the largest possible portion of the tensioning piston 136*a* can be extended from the cylinder 136, thereby enabling the drilling machine to be pulled forward as far as possible. However, it must be assured that the tensioning piston 136*a* is not entirely pulled during forward feeding (and vice versa during backward feeding), since it must be possible to maintain the tensioning piston 136*a* under pressure in order to keep the chains taut.

One way of achieving this, also providing a fully automated driving of the chain tensioners, is to apply the same pressure to the piston 136*c* during forward feed of the drilling machine, i.e., in the drilling direction C of the figure, as that on the feed cylinder's "-" (120*a* in FIG. 3), while at the same time the hydraulic pressure acting on the feed cylinder's inner drive surface (120*b* in FIG. 3) is interconnected with the pressure acting on the tensioning piston's 137*a* inner drive surface.

By adapting the piston diameters to the tensioning pistons 136, 137, the tensioning force on the front chain tensioner (piston 136*a*) can be made equal to the feeding force acting on the drilling machine during forward feeding.

In like fashion, the force of the rear tensioning piston can then be controlled by the feed cylinder's pressure during backward feeding (substantially lower forces are normally used in return feeding). Then, by letting the tensioning piston not under pressure (depending on the direction of movement) be drained (release pressure) by the same line that is draining the feed cylinder, the return pressure in the line will produce a tensioning force sufficient to keep the chain taut with a relatively small force. Thanks to the gear reduction caused by the pulley wheel (see below), the force of the feed cylinder will be twice as large as the feeding force.

If the feed cylinder is pressurised with a force 2F, the drilling machine will be subjected to a feeding force F (due to the gear reduction of the pulley wheel). This also means that the tensioning piston 136*a* will be subjected to a force F in the drilling direction. If the tensioning piston is designed to have an area corresponding to half the feed cylinder's "-" area, the tensioning piston 136*a* will also be subjected to a force F in opposite direction, thereby be "floating".

When the feed cylinder is fully retracted during forward feeding (and vice versa during return feeding), the force acting on the tensioning piston 136*a* in the drilling direction via the feed cylinder ceases, and the tensioning piston 136*a* can be pressed with the force F, so that the drilling machine can be pulled forward until it stops up against the end section 112, thereby ensuring that the drilling machine can be moved forward as far as possible with assured chain tension (and vice versa in return movement) and thus the feeding force F of the drilling machine is now maintained by the tensioning piston 136*a*. At the same time, the tensioning piston 137*a* is retracted by the (comparatively low) return pressure and it stretches the chain 133. Hence, the magnitude of the force F from the tensioning piston 136*a* can be controlled by its pressure area. If the tensioning piston is designed to apply a force in excess of F, it will begin to extend at the same time that the feed cylinder's piston is retracting.

Moreover, it will be appreciated that use of the two pulley wheels 130, 131 gives a gear reduction of 2:1 for the drilling machine, i.e., it will move at twice the speed of the feed beam (with half the force of the feed cylinder per above). Thus, the overall length of the feed unit becomes very short in relation to the total moving range of the drilling machine.

Even if the present invention has been described above with a chain design, it will be apparent that other suitable carriage pulling mechanisms can be used, such as steel wires. Moreover, the chain/steel wire need not consist of two separate pieces 132, 133, but can be a single chain/steel wire to which the carriage is suitably attached.

As the person skilled in the art will appreciate, the feed cylinder can also be pointed in the opposite direction to that shown in the figure, i.e., the feed beam would move to the left in the figure by an elongation of the piston 120.

Instead of the chains being attached to the feeder holder 106 by hydraulic cylinders 136, 137, the respective chain ends (or wire ends) in an alternative embodiment can be attached directly, or by ordinary slotted screws to the feeder holder, in which case the advantageous chain tensioning function of the embodiment in FIG. 3 is not achieved, for obvious reasons.

Moreover, the invention is described above in regard to a specific type of feed beam. But as is evident, the invention can also be used for other types of feed beams, e.g., feed beams with more or fewer guideways, or feed beams whose carriage slides along sliding surfaces and not necessarily on guideways. In principle, the present invention applies to any feed unit where a feed beam can move relative to a feeder holder, and where a drilling machine can move relative to the feed beam. Thus, the appearance of the feed unit may differ substantially from the sample embodiment shown in the figures without thereby diverging from the invention as defined in the accompanying claims.

Figure 4A:
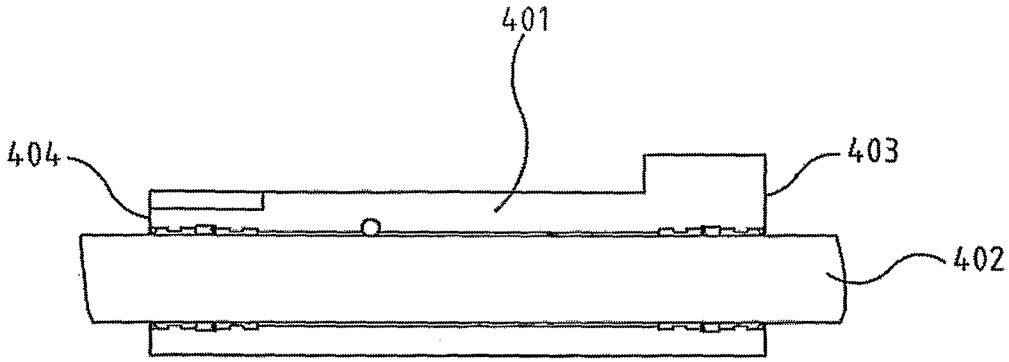
FIG. 4*a-b* shows an example of a forced-feed lubricated slide bearing to be used with guideways, e.g., in feeder holder and drilling machine carriage.
Figure 4B:
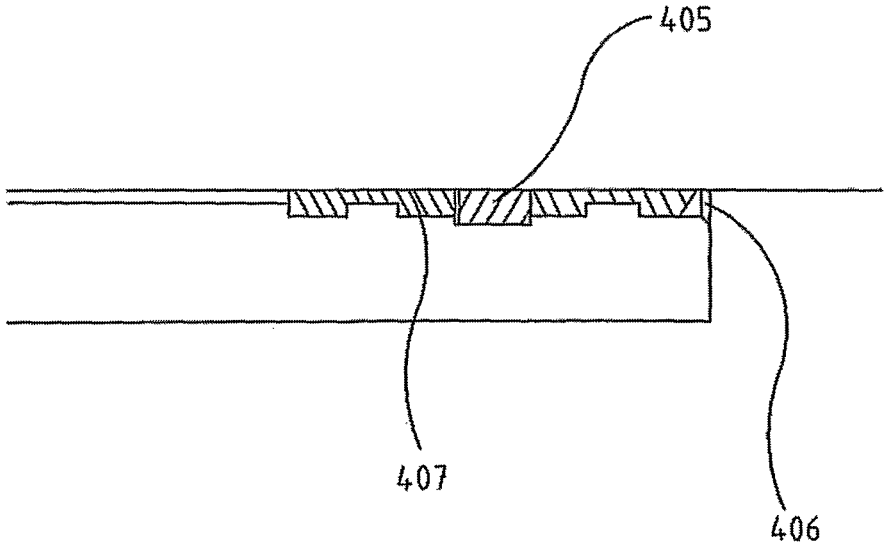

FIG. 4*a-b* shows an example of a pressure-lubricated sliding bearing to be used with guideway bushings in, for example, the feeder holder and drilling machine carrier per the above. FIG. 4*a* shows a bushing 401, such as bushing 109*a* in FIG. 2, and accompanying guideway 402. The bushing is provided at its respective end 403, 404 with a sealing/sliding bearing, shown in greater detail by FIG. 4*b*.

The sealing/sliding bearing consists of a scraping device 406, which makes sure no dirt on the guideway 402 gets into the bushing. Moreover, the sealing/sliding bearing comprises a lip seal 405, preventing lubricant such as oil or grease from leaking out of the inside of the bushing. The seal also has the advantage that the inside of the bushing can be kept pressurised with a certain excess pressure of lubricant, say, 3-5 bar. The arrangement also comprises sliding bearing surfaces 407. The arrangement shown in FIG. 4*a-b* has the benefit that the sliding bearing will function in a lubricant bath, which is very favourable in terms of friction and wear, since the bearing is normally subjected to powerful vibrations during drilling. Moreover, a thin oil (grease) film will be brought out with the guideway from the bushing and thereby protect against corrosion and prevent dirt from attaching to the guideway. The arrangement in FIG. 4*a-b* moreover has the advantage of avoiding play in the carriage/feed beam entirely or for the most part, which prolongs the lifetime and facilitates proper orienting of the drilling.

Figure 5:
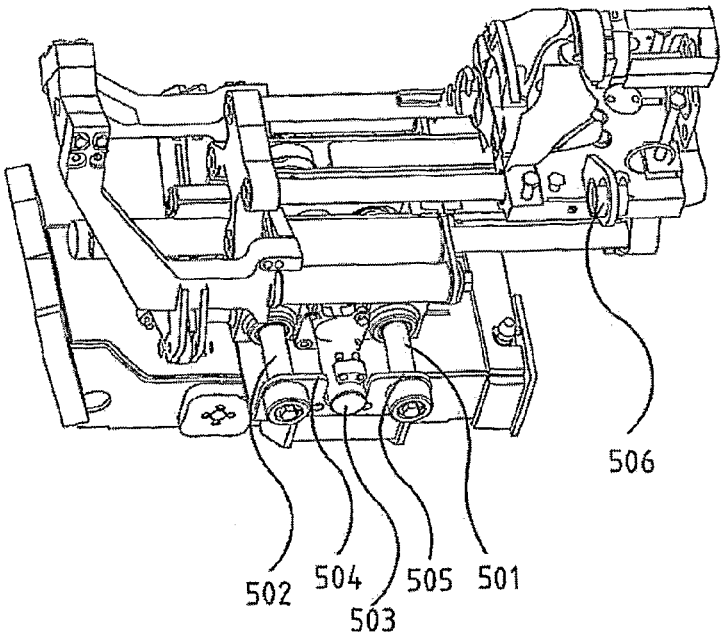
FIG. 5 shows the feed unit of FIG. 2 from a different perspective.

FIG. 5 shows the feed unit of FIG. 2, but from a different perspective, to illustrate a further advantage of the arrangement in FIG. 2. As noted above, the feed unit (feeder holder 106) is attached to the drilling support 103 via openings 107, 108 that run on guideways 501, 502, and whose movement along the guideways is controlled by a hydraulic cylinder 503.

During the drilling, the feed unit is moved along the guideways 501, 502 such that the feed unit is close to or even abuts against stops 504, 505, i.e., opposite what is shown in the figure, where the feed unit is moved away from the stop 504, 505 during drilling per the above.

On the other hand, when inserting a bolt into a newly drilled hole, the feed unit is moved along the guideways 504, 505 to the position shown in FIG. 5. This has the advantage that the bolt (or a first bolt section, if the bolt consists of several sections) can be placed against the drilled hole (or shoved partly into the hole) so as to place the end of the bolt away from the hole against a bolt support 506 arranged on the carriage 122, and then the bolt can be pressed into the hole by operation of the feed beam and carriage via the bolt support 506. This, in turn, has the advantage that the feed beam will automatically be properly oriented and thus it can easily be positioned, by operating the cylinder 503, in the position shown in FIG. 5 for pressing in the bolt.

Moreover, though the invention was exemplified in the above specification by a certain type of feed unit, it is equally applicable to other types of feed units, as long as a feed beam is moved in relation to a feeder holder and a drilling machine is designed to move along the feed beam.

The invention claimed is:

1. Feed unit to be used with a mining or construction machine, said feed unit comprising a feeder holder and a feed beam displaceable relative to the feeder holder, said feed unit further comprising a supporting unit to carry a drilling machine, wherein said supporting unit is arranged to support said drilling machine moveably in relation to said feed beam, and said feed unit furthermore comprises driving means to move said feed beam relative to said feeder holder in operation, wherein:

said supporting unit or drilling machine in operation is attached to said feeder holder such that, when said feed beam moves relative to said feeder holder by said driving means, the supporting unit or drilling machine is at the same time automatically moved along the feed beam;

said driving means having only a single actively controlled drive device for providing said automatic movement of said supporting unit or drilling machine relative to the feed beam at the same time said feed beam moves relative to said feeder holder.

2. Feed unit according to claim 1, wherein said driving means consist of a hydraulic cylinder or a hydraulic motor.

3. Feed unit according to claim 2, wherein said supporting unit is arranged to be fastened to said feeder holder, and said drilling machine to be fastened to said feeder holder via said supporting unit.

4. Feed unit according to claim 2, wherein said feed beam comprises at least one guideway, and said feeder holder comprises means to movably receive said guideway.

5. Feed unit according to claim 1, wherein said supporting unit is arranged to be fastened to said feeder holder, and said drilling machine to be fastened to said feeder holder via said supporting unit.

6. Feed unit according to claim 5, wherein said feed beam comprises at least one guideway, and said feeder holder comprises means to movably receive said guideway.

7. Feed unit according to claim 1, wherein said feed beam comprises at least one guideway, and said feeder holder comprises means to movably receive said guideway.

8. Feed unit according to claim 7, wherein said at least one first guideway is designed to travel in at least one respective lead-through bushing arranged in the feeder holder.

9. Feed unit according to claim 8, wherein said lead-through bushing or bushings comprise at least one sliding seal at respective openings to seal the inside of the bushing during movement of the guideway relative to the bushing.

10. Feed unit according to claim 7, wherein said feed beam comprises at least one second guideway, and movement of the feed beam relative to the feeder holder is designed to bring about movement of the supporting unit along said second guideway.

11. Feed unit according to claim 1, wherein said feed beam comprises at least one second guideway, and movement of the feed beam relative to the feeder holder is designed to bring about movement of the supporting unit along said second guideway.

12. Feed unit according to claim 1, wherein when said feed beam moves relative to said feeder holder at a first speed, said supporting unit or drilling machine is designed to move relative to said feed beam at a second speed, different from said first speed.

13. Feed unit according to claim 12, wherein said second speed is higher than said first speed.

14. Feed unit according to claim 1, wherein said driving means is integrated in or fastened to said feeder holder.

15. Feed unit according to claim 1, wherein said supporting unit or drilling machine is designed to move along said feed beam by a chain or wire, said chain or wire being designed to travel along said beam and parallel to said direction of movement, while respective ends of said chain or wire are attached to said feeder holder so that, when said feed beam moves relative to said feeder holder, the feed beam will move along said chain, whereupon the position of the supporting unit or drilling machine relative to the feed beam also changes.

16. Feed unit according to claim 15, wherein at least one of the respective ends of said chain or wire is fastened to said feeder holder via a respective tensioner.

17. Feed unit according to claim 15, wherein said tensioner is a hydraulic cylinder.

18. Feed unit according to claim 1, wherein said feeder holder further comprises fastening devices for fastening to a drilling support, said fastening means being arranged so that said feeder holder in operation can move relative to said drilling support in a direction basically perpendicular to the drilling direction.

19. Rock drilling or rock bolting rig, wherein said rig comprises at least one feed unit or a rock drilling or rock bolting assembly according to claim 1.

20. Rock drilling or rock bolting assembly to be used with a mining or construction machine, wherein said rock drilling assembly comprises a feeder holder and a feed beam movable relative to the feeder holder, said rock drilling assembly further comprising a drilling machine is arranged to be movable along said feed beam, and said rock drilling assembly furthermore comprises driving means to move said feed beam relative to said feeder holder in operation, wherein said drilling machine is attached to said feeder holder in operation such that, when said feed beam moves relative to said feeder holder by said driving means, the drilling machine is automatically moved at the same time along the feed beam; said driving means having only a single actively controlled drive device for providing said automatic movement of said supporting unit or drilling machine relative to the feed beam at the same time said feed beam moves relative to said feeder holder.

* * * * *

UNITED STATES PATENT AND TRADEMARK OFFICE

CERTIFICATE OF CORRECTION

PATENT NO. : 8,662,199 B2
APPLICATION NO. : 12/736649
DATED : March 4, 2014
INVENTOR(S) : Sven-Olov Nystrom It is certified that error appears in the above-identified patent and that said Letters Patent is hereby corrected as shown below:

In the Claims

Claim 17, Line 1 (Column 9, Line 9): Delete “claim 15”, and substitute --claim 16--.

Claim 20, Line 5 (Column 10, Line 5): Delete “is”.

Signed and Sealed this
Sixth Day of May, 2014

Michelle K. Lee

Michelle K. Lee
*Deputy Director of the United States Patent and Trademark Office*